US007798451B2

(12) United States Patent
Khan et al.

(10) Patent No.: US 7,798,451 B2
(45) Date of Patent: Sep. 21, 2010

(54) THREE-IN-ONE DOOR BRACKET

(75) Inventors: Tabraiz Ali Khan, Wichita, KS (US); Gregory Kenneth Reaser, Wichita, KS (US); Robert Cabrera, Wichita, KS (US)

(73) Assignee: Johnson Controls Technology Company, Holland, MI (US)

( * ) Notice: Subject to any disclaimer, the term of this patent is extended or adjusted under 35 U.S.C. 154(b) by 324 days.

(21) Appl. No.: 11/971,498

(22) Filed: Jan. 9, 2008

(65) Prior Publication Data

US 2008/0164385 A1 Jul. 10, 2008

Related U.S. Application Data

(60) Provisional application No. 60/884,261, filed on Jan. 10, 2007.

(51) Int. Cl.
*F16L 3/00* (2006.01)

(52) U.S. Cl. ..... 248/49; 248/205.1

(58) Field of Classification Search ..... 248/200, 248/205.1, 49, 65; 312/100, 223.1
See application file for complete search history.

(56) References Cited

U.S. PATENT DOCUMENTS

| | | | | |
|---|---|---|---|---|
| 5,405,111 | A * | 4/1995 | Medlin, Jr. | 248/205.1 |
| 6,343,771 | B1 * | 2/2002 | Simon | 248/49 |
| 6,520,608 | B1 * | 2/2003 | Nelson et al. | 312/223.1 |
| 2005/0285492 | A1 * | 12/2005 | Hu et al. | 312/334.4 |

* cited by examiner

*Primary Examiner*—Ramon O Ramirez
(74) *Attorney, Agent, or Firm*—McNees Wallace & Nurick, LLC

(57) ABSTRACT

A HVAC system is provided having a three in one door bracket. The door bracket is configured to mount a door on the HVAC and to secure wiring within the HVAC. Various door arrangements may be used with the exemplary door bracket and at least one wire, or a plurality of wires, may be secured in the wire retention area of the door bracket. The door bracket can mount a variety of doors, regardless of the fastener requirements because of the dual fastener areas on the bracket.

20 Claims, 5 Drawing Sheets

THREE-IN-ONE DOOR BRACKET

CROSS REFERENCE TO RELATED PATENT APPLICATIONS

This application claims the benefit of U.S. Provisional Application No. 60/884,261, filed Jan. 10, 2007.

BACKGROUND

The present application relates generally to a bracket for a HVAC system and more specifically to a bracket configured to mount to a door on a HVAC and to secure wiring within the HVAC.

The basic components of a typical furnace or HVAC system are: a burner, a heat exchanger, an air distribution system, and a vent pipe. The burner utilizes gas (natural or propane) or oil to generate heat. The heat exchanger transfers the heat from the burner to the air distribution system. The air distribution system, which includes a blower and ductwork, delivers the heated air throughout the home (or other enclosed space) and returns cooler air to the furnace to be heated. Finally, the vent pipe, or flue, exhausts byproducts of combustion in the burner (such as water vapor and carbon dioxide) outside of the home or enclosed space. In addition, the HVAC system may also include a cooling element, such as an A-coil, that operates in conjunction with an air conditioning unit to provide cooled air to the home instead of heated air, when so desired. The size of the A-coil is directly related to the efficiency rating of the system.

Typically, furnace systems in residential applications are located in the basement or a small closet in the user's home, which areas have limited space for an installed furnace system. Furthermore, efficiency standards have recently changed, thereby requiring the size of the A-coil to be increased to meet these new standards. Thus, when a newer furnace system is needed to replace an older system, often, the newer furnace can not fit into the space where the old furnace was installed because the size of the furnace unit and the newer, taller A-coil that is required is greater than the available installation space. Thus, a shorter, furnace is needed to accommodate the taller A-coil in order to be able to install a new furnace system in the same space as the old furnace system.

Each individual HVAC or furnace system has separate requirements for the door panel, depending on the requirements of the system. In addition, every HVAC system has a plurality of wires that are routed throughout the system. What is needed is a system or method of a door bracket that will facilitate a variety of door panels to be mounted to the HVAC system housing and contain and route the wires for the system as well.

Intended advantages of the disclosed systems and/or methods satisfy one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY

One embodiment is directed to a door bracket having a bracket with a top, a bottom, a front and a back. The bracket also having a first fastener area for receiving at least one fastener, a second fastener area for receiving at least one fastener and a wire retention area. The bracket secures a predetermined door panel with one of the first fastener area or the second fastener area. The bracket is configured to receive and route at least one wire through the wire retention area.

Another embodiment is directed to a door bracket having a housing to enclose an HVAC system, the housing having an opening for a door panel. The embodiment is also directed to a door bracket disposed in the opening of the housing, and extending substantially the width of the opening, and having a front and a back. The bracket has a first fastener area and a second fastener area configured to receive at least one fastener and a wire retention area for receiving and routing at least one wire. The door bracket being configured to receive and support a predetermined door panel.

Yet another embodiment is directed to a method for affixing a door to an HVAC housing including the steps of providing an HVAC system having an enclosure with an opening, providing a door bracket extending substantially the width of the opening. The door bracket has a front and a back, and a first fastener area and a second fastener area. The first and second fastener areas are configured to receive at least one fastener. The door bracket also has a wire retention area for receiving and routing at least one wire. The method also includes disposing the door bracket in the opening of the HVAC enclosure, affixing a door panel to the door bracket with at least one fastener using one of the first fastener area and the second fastener area, and routing at least one wire through the wire retention area of the door bracket.

One advantage is that various low cost door arrangements may be used with the door bracket.

Another advantage is that high end door arrangements may be used with the door bracket.

Yet another advantage is that at least one wire or multiple wires may be routed and contained within the wire retention area and properly sealed.

Still another advantage is that the wires routed in the wire retention area are easily accessible and removable when desired.

Other features and advantages will be apparent from the following more detailed description of the embodiments, taken in conjunction with the accompanying drawings which illustrate, by way of example, the principles of the application.

BRIEF DESCRIPTION OF THE DRAWINGS

Wherever possible, the same reference numbers will be used throughout the drawings to refer to the same or like parts.

DETAILED DESCRIPTION

Figure 1:
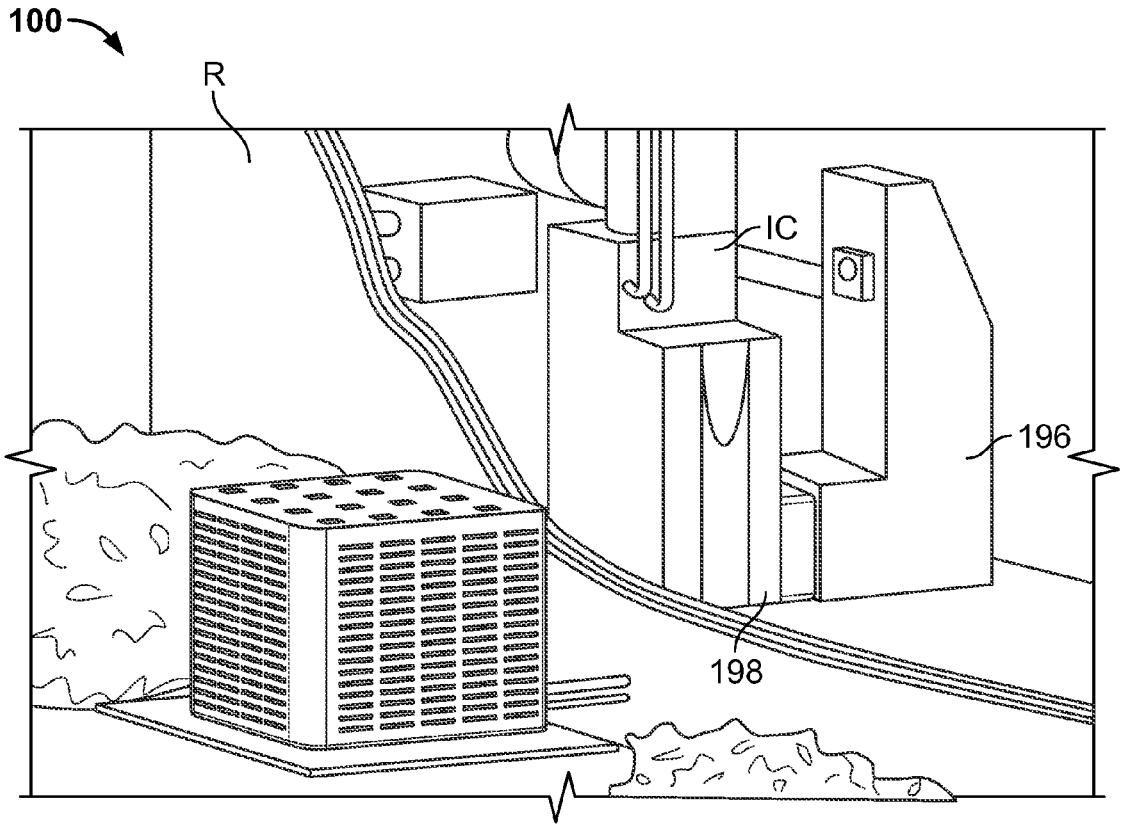
FIG. 1 is an illustration of an exemplary HVAC system disposed in a residential setting.
Figure 2:
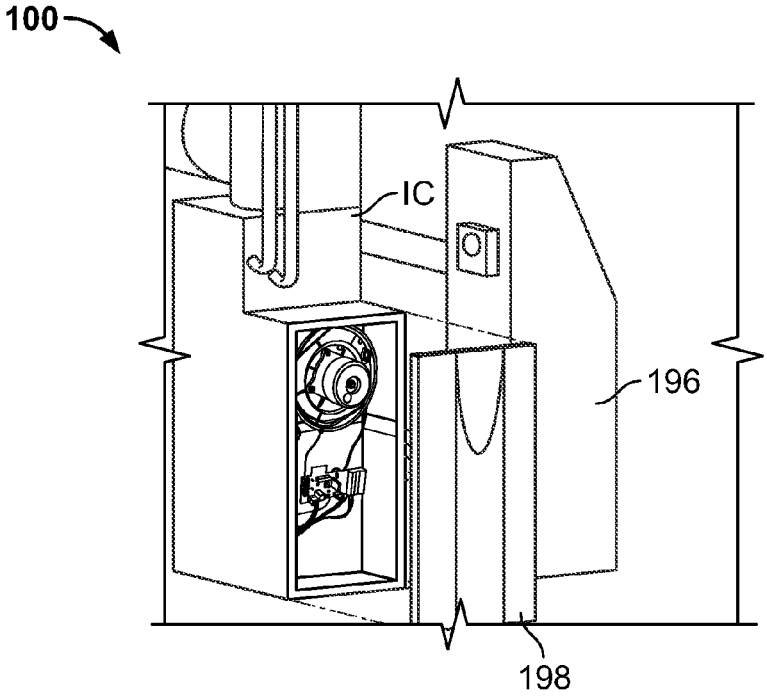
FIG. 2 is a partially exploded view of an exemplary HVAC system according to an exemplary embodiment of the disclosure.

FIG. 1 shows an exemplary HVAC or furnace system 100 in a typical residential setting R. Further, FIG. 2 illustrates an exemplary HVAC or furnace system 100 having an enclosure 196 with a door panel 198. The door panel 198 allows access to the internal portion of the furnace system 100, described in detail below.

Figure 3:
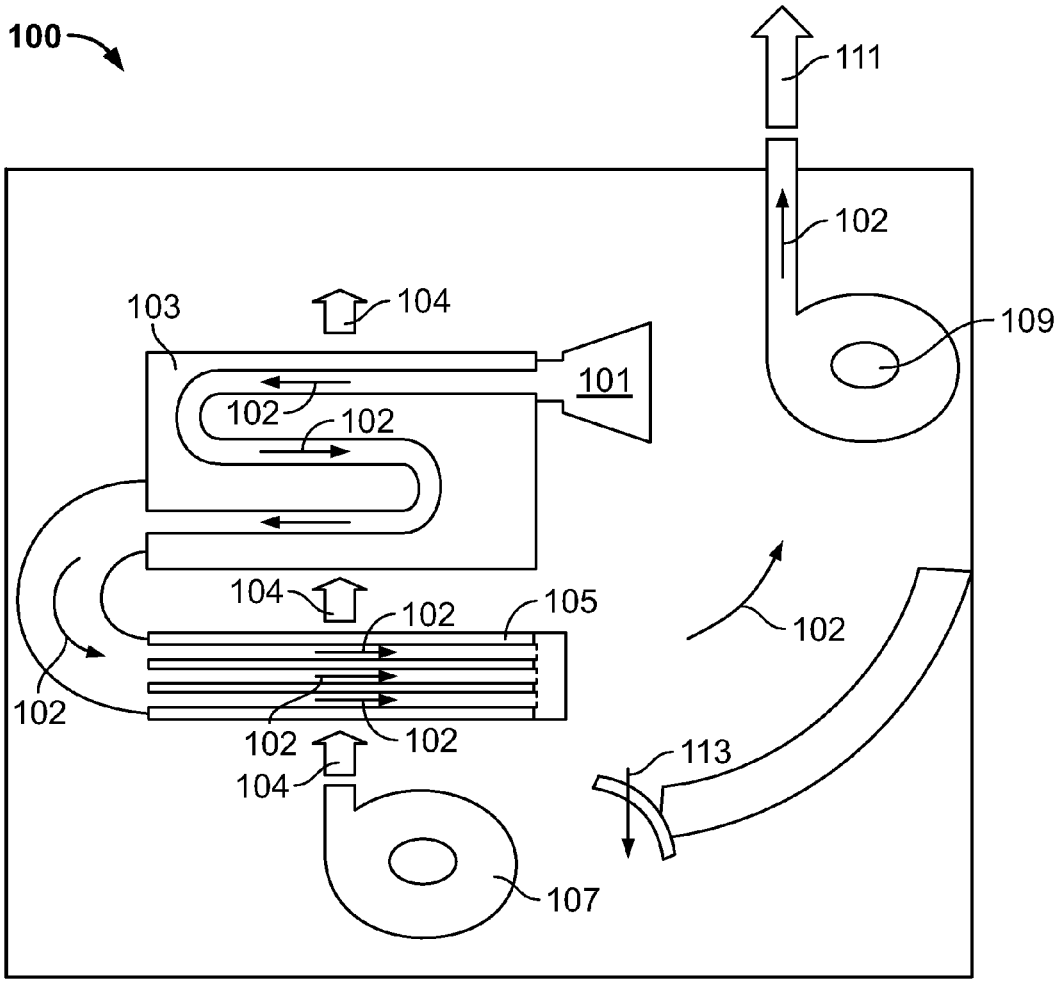
FIG. 3 is a schematic arrangement of a furnace system according to an embodiment of the disclosure.

FIG. 3 shows a schematic arrangement of the internal portion of the furnace system 100. During operation, a burner 101 combusts fuel with combustion air 102 and provides combustion products and heated air to a first heat exchanger 103, where heat is transferred to a supply air 104. Supply air 104 is air that is to be heated, such as interior air for a building HVAC system. Combustion air 102 is then directed into a second heat exchanger 105, where heat is exchanged with supply air 104. Supply air 104 is directed over first heat exchanger 103 and second heat exchanger 105 by use of a blower 107 or similar air-moving device. Combustion air 102 is then exhausted from the system 100 by use of an exhaust blower 109 or other air-moving device. Exhaust 111 includes air, water vapor and other combustion products. Furnace system 100 provides heat to supply air 104 by use of first heat exchanger 103 and second heat exchanger 105. Supply air 104 is than provided to a space for heating.

Figure 4:
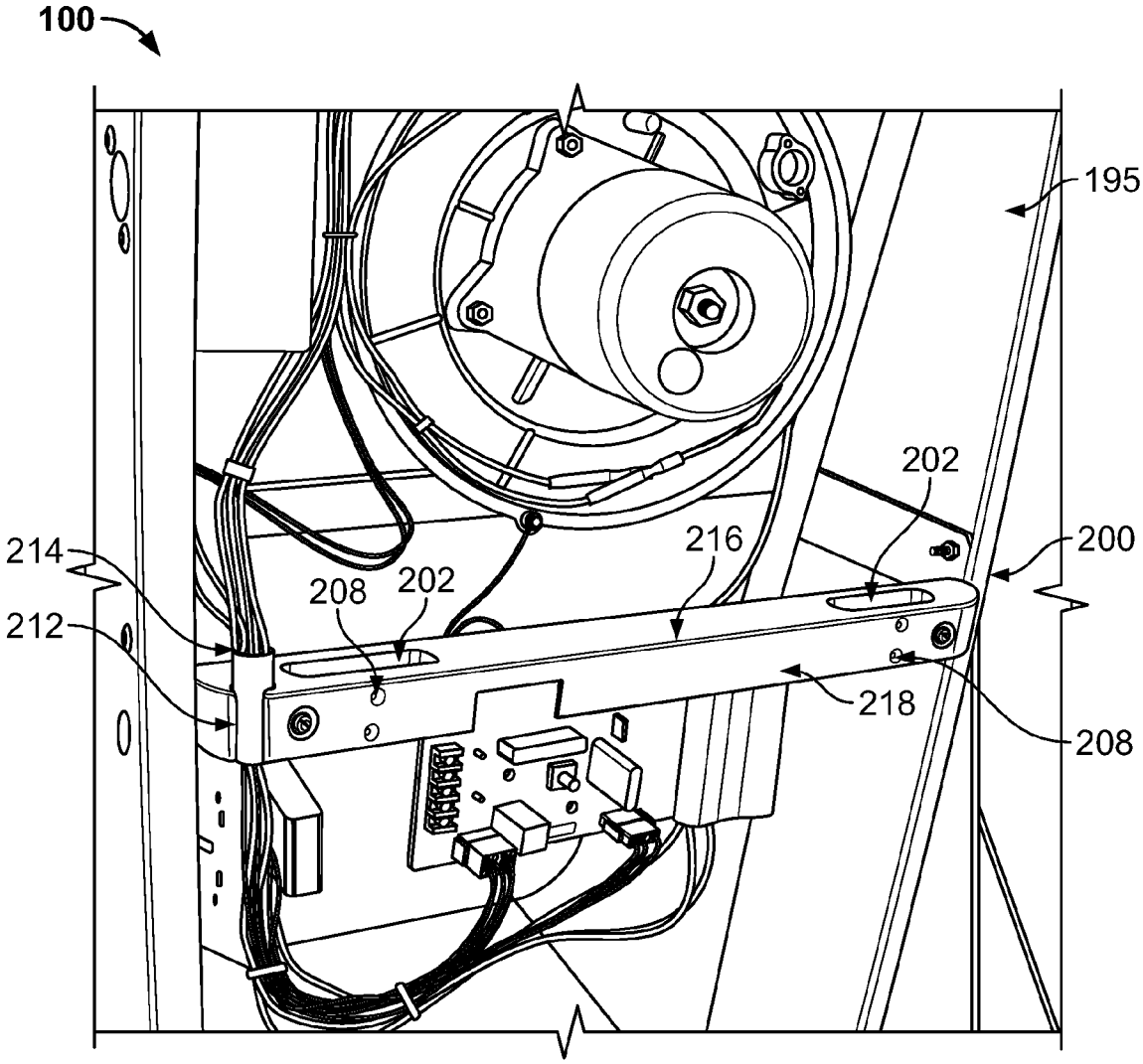
FIG. 4 is a view of the door bracket disposed in the HVAC system.

An exemplary embodiment of the disclosed door panel bracket 200 as applied to a furnace or an HVAC system 100 is shown in FIG. 4. While reference to an HVAC system 100 is used in this application, it is known by those skilled in the art that the door panel bracket may be used in a furnace system as well. The exemplary door panel bracket 200 is a single unitary piece. It is known by those of ordinary skill in the art that the bracket 200 may not be a unitary piece, and may be several smaller pieces connected together to form a larger piece. The door panel bracket 200 extends across the entire width of the door panel opening 195. The door panel bracket 200 may be placed at the top of the door panel opening 195, the bottom of the door panel opening 195, or anywhere in between. However, the exemplary embodiment shows the door panel bracket 200 in the center (lengthwise) of the door panel opening 195.

The door panel bracket 200 helps to secure different types of door panels 198 to the enclosure 196. The door panel bracket 200 has one or more first fastener areas 202 that can accommodate door panels 198 that use ¼ turn fasteners, or any other suitable fasteners. The door panel bracket 200 also has one or more second fastener areas 208 that accommodate door panels 198 that use screws or other similar fastening devices. Depending on the door panel type used for the HVAC system, only one (the one or more first fastener area 202 or the one or more second fastener area 208) fastener area 202, 208 is used at a time. By incorporating the two fastener areas 202, 208 into the same door panel bracket 200, the HVAC system 100 can accommodate different types of door panels 198. It is to be understood that while one configuration and arrangement of both the first fastener areas 202 and the second fastener areas 208 is shown in FIGS. 4-8, other configurations and arrangements of the first fastener areas 202 and the second fastener areas 208 could also be used. Further, the exemplary embodiment illustrates two first fastener areas 202 and two second fastener areas 208, however, any suitable number of first and second fastener areas 202, 208 may be used.

In addition, as shown in FIG. 4, the door bracket 200 also has a wire retention area 212 incorporated into the bracket 200. The wire retention area 212 is located in the front of the bracket 200 near the door, but could alternatively be located opposite the door at the back of the bracket 200. The placement of the wire retention area 212 in the front of the bracket 200 permits the wiring in the HVAC system 100 to be sealed or restrained in a simple and accessible manner. The wire retention area 212 allows the at least one wire routed within to be sealed properly while providing a simple and easy removal of the wire from the HVAC system if necessary.

Figure 5:
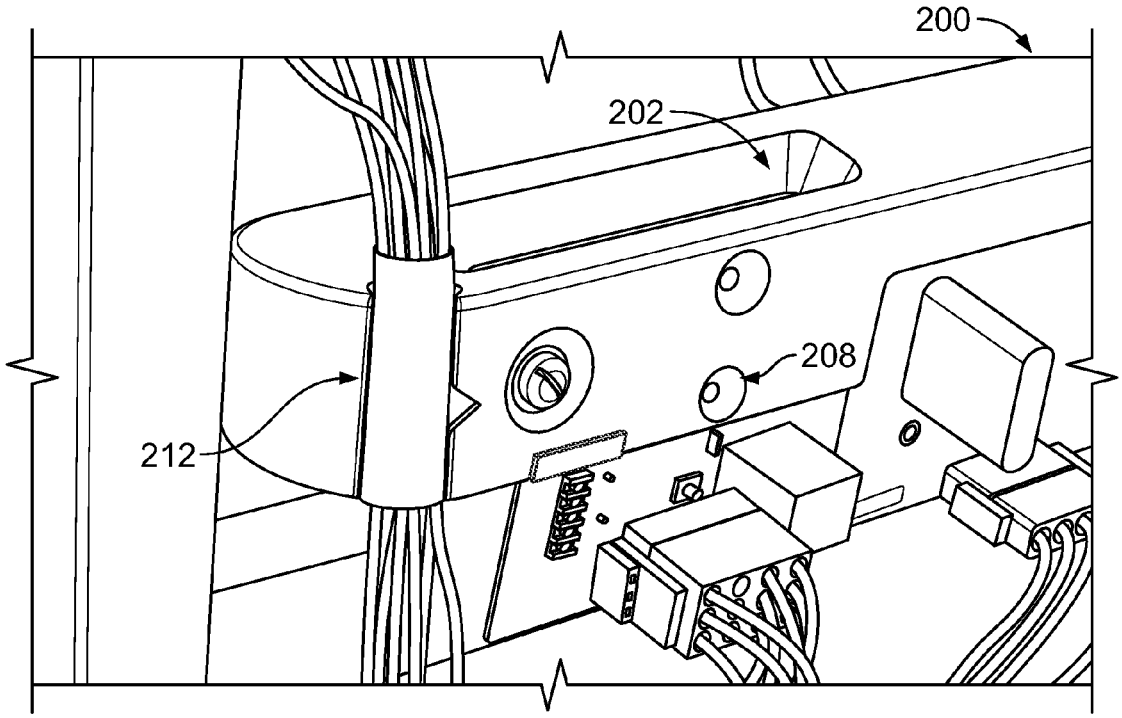
FIG. 5 is a close up view of the door bracket disposed in the HVAC system.

Now referring to FIG. 5, a closer look at the door bracket 200 illustrates the wire retention area 212 in relation to the first fastener area 202 and the second fastener area 208. An exemplary wire retention area 212 is an aperture in the door bracket 200. At least one wire, or a plurality of wires 214, are placed through the aperture and are contained within the aperture to prevent them from separating or tangling. All edges of the wire retention area 212 are rounded or provided in such a way that the wires are not exposed to sharp edges that might cut the wires. In the exemplary embodiment, the first fastener area 202 provides the capability to fasten the door bracket 200 from the top surface 216, and the second fastener area 208 provides the capability to fasten the door bracket 200 from the side surface 218.

Figure 6:
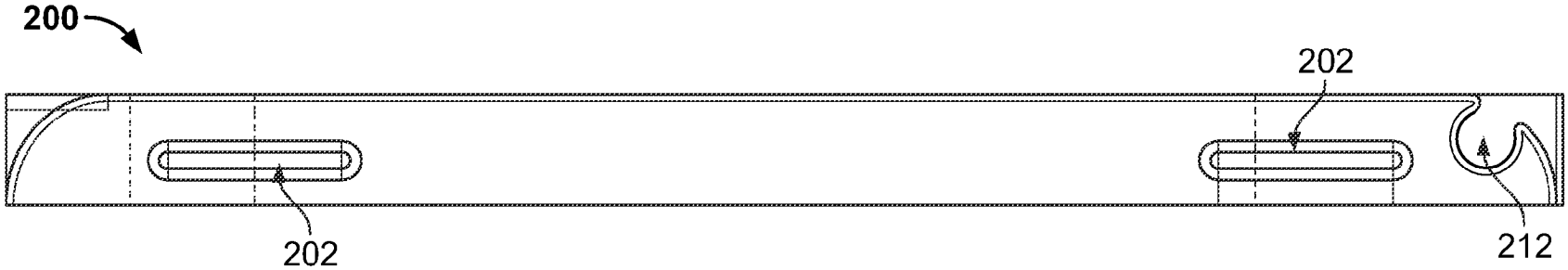
FIG. 6 is a top schematic view of the door bracket.
Figure 7:
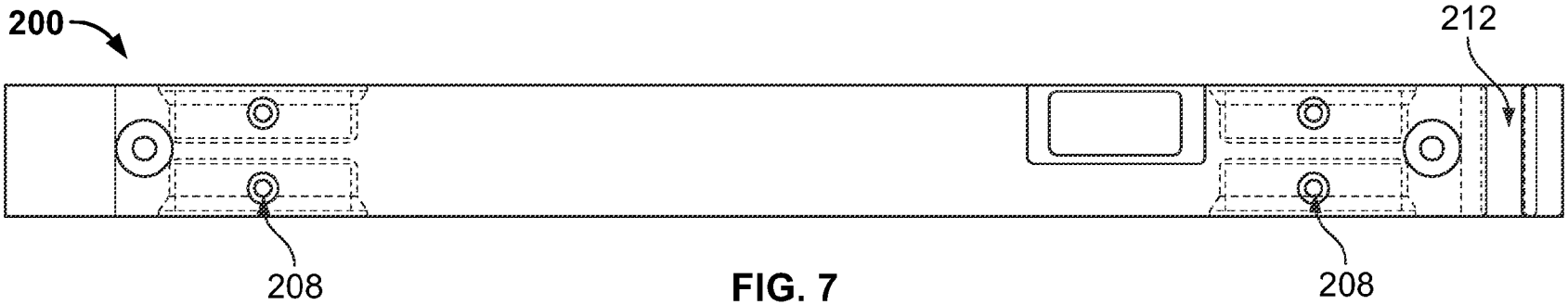
FIG. 7 is a side schematic view of the door bracket.
Figure 8:
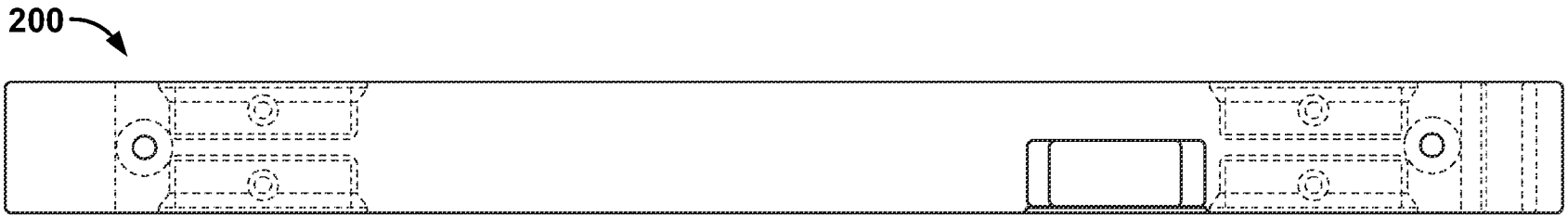
FIG. 8 is a bottom view of the door bracket.

FIGS. 6-8 illustrate the top, side, and bottom views, respectively, of an exemplary embodiment of the door bracket 200. The wire retention area 212 is shown as being disposed in the front of the door bracket 200, however, the wire retention area 212 may be disposed in the back of the door bracket 200. The wire retention area 212 may also be disposed on the opposite end of the door bracket 200 than is shown in the figures. The exemplary embodiments illustrate two each of the first fastener area 202 and the second fastener area 208, however, more first and second fastener areas 202, 208 may be used if desired.

While the systems and/or methods of the application have been described with reference to several embodiments, it will be understood by those skilled in the art that various changes may be made and equivalents may be substituted for elements thereof without departing from the scope of the application. In addition, many modifications may be made to adapt a particular situation or material to the teachings of the application without departing from the essential scope thereof. Therefore, it is intended that the application not be limited to the particular embodiment disclosed as the best mode contemplated for carrying out the systems and/or methods of the application, but that the application will include all embodiments falling within the scope of the appended claims.

What is claimed is:

1. A door bracket to secure a door panel, the door bracket comprising:
   - member having a width corresponding to a width of the door panel, the member comprising:
     - a first fastener area configured to receive at least one first fastener type;
     - a second fastener area configured to receive at least one second fastener type; and
     - a wire retention area;
   - wherein the member is configured to secure the door panel with one of the first fastener area or the second fastener area, and the wire retention area is configured and positioned to receive and guide at least one wire through the member.

2. The door bracket of claim 1 wherein the first fastener type comprises ¼ turn fasteners.

3. The door bracket of claim 1 wherein the second fastener type comprises screws.

4. The door bracket of claim 1 wherein the wire retention area is located near the door panel upon the securing of the door panel to the member.

5. The door bracket of claim 1 wherein the wire retention area is located opposite the door panel upon the securing of the door panel to the member.

6. The door bracket of claim 1 wherein the wire retention area comprises an aperture in the member and the aperture is configured and positioned to restrain the at least one wire while permitting access to the at least one wire.

7. The door bracket of claim 1 wherein the first fastener area is used to secure the door panel.

8. The door bracket of claim 1 wherein the second fastener area is used to secure the door panel.

9. An HVAC system comprising:

a housing, the housing comprising an opening;

a door panel configured to cover the opening in the housing;

a bracket positioned in the opening of the housing, the bracket extending substantially a width of the opening, the bracket comprising a first fastener area to receive a first fastener, a second fastener area to receive a second fastener, and an aperture extending through the bracket to receive and guide at least one wire;

wherein the bracket is configured to receive, support and secure the door panel with at least one of the first fastener area or the second fastener area.

10. The system of claim 9 wherein the first fastener comprises ¼ turn fasteners.

11. The system of claim 9 wherein the second fastener comprises screws.

12. The system of claim 9 wherein the aperture is located near the door panel.

13. The system of claim 9 wherein the aperture is located opposite the door panel.

14. The system of claim 9 wherein the aperture is configured and positioned to restrain the at least one wire while permitting access to the at least one wire.

15. The system of claim 9 wherein the first fastener area and the second fastener area are positioned on perpendicular sides of the bracket.

16. The system of claim 15 wherein the first fastener area permits fastening from a top surface of the bracket and the second fastener area permits fastening from a side surface of the bracket.

17. A method for affixing a door to an HVAC housing comprising the steps of:

providing an HVAC system having an enclosure with an opening;

providing a door bracket, the door bracket extending substantially the width of the opening, and having a front and a back, having a first fastener area and a second fastener area configured to receive at least one fastener and a wire retention area for receiving and routing at least one wire;

disposing the door bracket in the opening of the HVAC enclosure;

affixing a door panel to the door bracket and secure the panel to the bracket with at least one fastener using one of the first fastener area and the second fastener area; and routing at least one wire through the wire retention area of the door bracket.

18. The method of claim 17 wherein the step of disposing a door bracket in the opening of the HVAC enclosure further comprises the wire retention area being located in the front of the door bracket.

19. The method of claim 17 wherein the step of disposing a door bracket in the opening of the HVAC enclosure further comprises the wire retention area being located in the back of the door bracket.

20. The method of claim 17 further comprising the step of sealing the at least one wire once it is routed through the wire retention area.

* * * * *

UNITED STATES PATENT AND TRADEMARK OFFICE

CERTIFICATE OF CORRECTION

PATENT NO. : 7,798,451 B2
APPLICATION NO. : 11/971498
DATED : September 21, 2010
INVENTOR(S) : Khan et al.

It is certified that error appears in the above-identified patent and that said Letters Patent is hereby corrected as shown below:

Column 4, line 44, "member having a width" should read --a member having a width--

Signed and Sealed this
Twenty-second Day of March, 2011

David J. Kappos

David J. Kappos
*Director of the United States Patent and Trademark Office*